US010687619B2

(12) United States Patent
Abramov

(10) Patent No.: US 10,687,619 B2
(45) Date of Patent: Jun. 23, 2020

(54) SYSTEM FOR HOLDING A CONTAINER

(71) Applicant: Shmuel Pesahov, Beer Sheva (IL)

(72) Inventor: Refael Abramov, Rishon Lezion (IL)

(73) Assignee: Shmuel Pesahov, Beer Sheva (IL)

( * ) Notice: Subject to any disclaimer, the term of this patent is extended or adjusted under 35 U.S.C. 154(b) by 0 days.

(21) Appl. No.: 16/070,764

(22) PCT Filed: Jan. 29, 2017

(86) PCT No.: PCT/IL2017/050102
§ 371 (c)(1),
(2) Date: Jul. 17, 2018

(87) PCT Pub. No.: WO2017/141230
PCT Pub. Date: Aug. 24, 2017

(65) Prior Publication Data

US 2019/0059581 A1 Feb. 28, 2019

(30) Foreign Application Priority Data

Feb. 15, 2016 (IL) ..... 244138

(51) Int. Cl.
*A47B 73/00* (2006.01)
*A47F 7/28* (2006.01)
*F16M 13/02* (2006.01)

(52) U.S. Cl.
CPC ..... *A47B 73/00* (2013.01); *A47F 7/285* (2013.01); *F16M 13/027* (2013.01)

(58) Field of Classification Search
CPC ..... A47B 73/00; A47B 73/004; A47B 73/006; A47B 73/008; A47B 81/007; A47F 7/285; A47F 7/28; F16M 13/027
USPC ..... 211/74, 75, 113; 248/102–107; 206/702
See application file for complete search history.

(56) References Cited

U.S. PATENT DOCUMENTS 139,915 A * 6/1873 Piper ..... A47B 73/00 211/74
245,257 A * 8/1881 Wright ..... B60R 22/34 242/379
264,593 A * 9/1882 Wright ..... B65H 75/4434 242/385.1
749,291 A * 1/1904 Hicks ..... A47B 73/00 211/134

(Continued)

FOREIGN PATENT DOCUMENTS

AT 8694 B 8/1902
DE 200 01 829 U1 6/2000

(Continued)

*Primary Examiner* — Jonathan Liu
*Assistant Examiner* — Devin K Barnett
(74) *Attorney, Agent, or Firm* — Vorys, Sater, Seymour and Pease LLP

(57) ABSTRACT

A system for holding at least one container, comprising: at least one holder configured to grip said container; and a retracting mechanism having a base portion mountable to a fixed location, and a distal end connectable to said holder; wherein said holder is displaceable by said retracting mechanism between a normally retracted position and an extended position, so that the length of said retracting mechanism is increased more at said extended position than the length at said retracted position.

10 Claims, 7 Drawing Sheets

(56) References Cited

U.S. PATENT DOCUMENTS 750,063 A * 1/1904 Redding ..... A47B 73/00 206/9
898,584 A * 9/1908 La Bau ..... B65G 7/12 211/74
1,014,004 A * 1/1912 Irwin ..... A61J 9/06 211/113
1,165,840 A * 12/1915 Brutus ..... A62C 13/78 211/74
1,692,098 A 11/1928 Sullivan
1,750,672 A 3/1930 Krischer
1,867,992 A 7/1932 Sullivan
2,018,395 A * 10/1935 Bower ..... C25D 17/06 204/297.06
2,057,946 A * 10/1936 Harris ..... A47G 29/24 211/75
2,060,170 A 11/1936 Buck et al.
2,517,829 A 8/1950 Beckovich
4,074,637 A * 2/1978 Lorenzen, Jr. ..... A47F 7/024 109/38
4,120,401 A * 10/1978 Newman ..... A45C 11/16 206/566
4,486,169 A * 12/1984 Lewis ..... F23Q 2/34 206/85
4,880,197 A * 11/1989 Wsyzynski ..... A63H 33/006 248/324
5,016,845 A 5/1991 Pellegrino
5,232,105 A * 8/1993 Gregg ..... A63H 33/22 211/1.52
5,310,152 A * 5/1994 O'Neill ..... A47B 81/06 248/324
5,358,128 A * 10/1994 Belokin ..... A47B 73/008 211/75
5,664,745 A * 9/1997 Hadaway ..... A61J 9/00 215/11.1
5,685,436 A * 11/1997 Davet ..... A47F 7/024 211/163
5,697,526 A * 12/1997 Lee ..... A47G 19/183 222/113
5,954,288 A * 9/1999 Shih ..... A45F 5/004 242/380
5,971,238 A * 10/1999 Malvasi ..... A45F 3/16 224/148.6
6,161,703 A * 12/2000 Mihok ..... A47G 25/10 211/31
6,257,469 B1 * 7/2001 Cohn ..... A45F 5/004 206/86
6,330,949 B1 * 12/2001 DeRisio ..... A47F 5/0006 211/113
6,467,736 B1 * 10/2002 Chiang ..... A61J 9/0638 248/102
6,499,899 B2 * 12/2002 Sawyer ..... B43K 23/002 24/10 R
6,612,530 B1 * 9/2003 Kwak ..... A47K 5/04 211/113
6,918,669 B1 * 7/2005 Tamborrino ..... G02C 3/04 242/380
7,209,038 B1 * 4/2007 Deconinck ..... G08B 13/1409 340/541
7,270,289 B2 * 9/2007 Kish ..... A45F 5/004 242/280
7,762,215 B2 * 7/2010 Horton ..... A01K 27/004 119/796
8,056,740 B2 * 11/2011 Weshler ..... A47F 7/024 211/119.003
8,292,097 B2 * 10/2012 Goldberg ..... A47F 7/024 206/560
8,672,146 B1 * 3/2014 Cole ..... A47B 61/003 211/117
8,746,519 B2 * 6/2014 Young ..... A45F 5/021 224/162
8,757,532 B2 * 6/2014 Votel ..... B65H 75/4434 242/378
8,770,533 B2 * 7/2014 Hand ..... E04B 9/006 242/379.2
9,718,640 B2 * 8/2017 Burner ..... G09F 21/02
10,045,639 B2 * 8/2018 Johnson ..... A47F 5/0043
10,086,640 B2 * 10/2018 Kish ..... B43K 23/001
2002/0162918 A1 11/2002 Suh
2003/0076015 A1 4/2003 Ehrenreich et al.
2004/0026556 A1 * 2/2004 Kish ..... A45F 5/004 242/380
2004/0089621 A1 * 5/2004 Gangloff ..... A47B 73/004 211/74
2004/0089622 A1 * 5/2004 Miller ..... B65D 73/0028 211/113
2005/0170743 A1 * 8/2005 Wells ..... A63H 33/006 446/227
2005/0242048 A1 * 11/2005 Guido ..... A47F 7/285 211/74
2006/0060548 A1 * 3/2006 Robertson ..... A47F 3/0486 211/74
2006/0163181 A1 * 7/2006 Caradonna ..... A47B 73/004 211/74
2006/0283081 A1 * 12/2006 Killen ..... A47G 7/047 47/67
2007/0023557 A1 * 2/2007 Rankin ..... A45F 5/004 242/381
2007/0152819 A1 * 7/2007 Marszalek ..... G08B 13/1409 340/568.4
2007/0295868 A1 * 12/2007 Kemper ..... A47L 15/505 248/102
2008/0035778 A1 * 2/2008 Belden ..... A45F 5/004 242/375
2008/0222849 A1 * 9/2008 Lavoie ..... A45F 5/02 24/3.13
2008/0264884 A1 * 10/2008 Felder ..... B25H 3/00 211/117
2009/0058643 A1 * 3/2009 Groth ..... G08B 13/128 340/568.1
2009/0071921 A1 * 3/2009 Harwin ..... A47B 43/006 211/74
2011/0186533 A1 * 8/2011 Thrush ..... A47F 5/08 211/113
2012/0018610 A1 * 1/2012 Kempf ..... B66D 3/18 248/636
2012/0193366 A1 * 8/2012 Miller ..... B65D 81/3879 220/592.17
2013/0087520 A1 * 4/2013 Cutler ..... A47K 3/281 211/85.12
2013/0264300 A1 * 10/2013 Shaffer ..... A47F 5/0006 211/117
2014/0027390 A1 * 1/2014 Reynolds ..... A47F 7/024 211/4
2014/0216209 A1 * 8/2014 Shrock ..... B67B 7/16 81/3.25
2014/0246402 A1 * 9/2014 Tschanen ..... B27C 3/02 217/6
2014/0263115 A1 * 9/2014 Jimenez-Rios ..... B01L 9/06 211/74
2015/0335150 A1 * 11/2015 Frisby ..... A47B 45/00 211/207
2016/0050774 A1 * 2/2016 Merenda ..... H05K 5/0086 224/162
2016/0213181 A1 * 7/2016 Gonzalez, II ..... B65D 23/0842
2016/0363263 A1 * 12/2016 Stockham ..... F16M 13/027
2017/0086580 A1 * 3/2017 Conti ..... A47G 23/02
2018/0299063 A1 * 10/2018 Hall ..... F16M 13/027

FOREIGN PATENT DOCUMENTS

GB 2 090 129 A 7/1982
GB 2 233 238 A 1/1991
WO 98/18116 A1 4/1998

* cited by examiner

SYSTEM FOR HOLDING A CONTAINER

CROSS-REFERENCE TO RELATED APPLICATIONS

This application is a U.S. National Phase of International Application No. PCT/IL2017/050102, filed Jan. 29, 2017 which claims the priority benefit of Israeli Application Serial No. 244138 filed Feb. 15, 2016 the disclosure of which is incorporated herein by reference.

TECHNOLOGICAL FIELD

The presently disclosed subject matter is related to the field of systems capable of holding containers, in particular, containers for dispensing substance.

BACKGROUND

Containers such as bottles are used in many fields. One of these fields is alcoholic liquids served in a bar. In this field there are stationary bottle holders called 'bar butles' in which a plurality of bottles are disposed upside down without the ability to be retracted. In order to serve the liquid within the bottle, the user has to activate a pour spout, which thereby allows the liquid to flow from the bottle. The bottles in the 'bar butles' are non-retractable, and therefore may not be convenient for use by a bartender.

GENERAL DESCRIPTION

According to one aspect of the presently disclosed subject matter, there is provided a system for holding at least one container, comprising:

at least one holder configured to grip said container; and a retracting mechanism having a base portion mountable to a fixed location, and a distal end connectable to said holder.

The holder is displaceable by said retracting mechanism between a normally retracted position and an extended position, so that at the extended position the length of said retracting mechanism is increased more than the length at said retracted position. Particularly, said holder can be spaced from the base portion to an extent greater than at said retracted position.

The term 'container' refers hereinafter to any receptacle capable of accommodating goods, or any other substance such as liquids, and can be, for example, a bottle configured for containing various types of liquids (e.g., alcoholic liquids).

The presently disclosed subject matter can be used in various fields in which containers including liquids are used. By using the presently disclosed subject matter, the liquids can be supplied to a user upon demand in a convenient manner. These fields include, for example, a bar, or a kitchen, and the user can be, for example, a bartender or a cook. When used in a bar by a bartender, a container in the form of a bottle can be mounted to the holder above the workspace (e.g., the table of the bar) and above the sightline of the bartender. When the bartender intends to use the bottle in order to serve its liquid, he can pull the bottle by his hand towards the workspace. Once accomplishing this operation, the bottle will automatically revert to its normally retracted position. The above described structure and intended use of the presently disclosed subject matter allows for saving workspace while providing visual contact between the bartender and a client. In addition, the automatic operation of the retracting mechanism saves time, which is a very important factor during the bartender's or the cook's work.

The system can further comprise a housing constituting said fixed location, so that the base portion is mountable to said housing.

The housing can comprise a cage having at least one opening at its bottom for allowing the holder to pass therethrough between its retracted and extended positions, so that at said retracted position, at least a portion of the holder is disposed within said cage.

The housing can further comprise a stopping element configured for delimiting movement of the holder with respect to the housing when being displaced from its extended position to its retracted position. The stopping element has a stopper bottom surface configured to engage said at least one holder at its retracted position, and an opposite stopper top surface. The stopping element can constitute an upper portion of the cage, wherein the base portion of the retracting mechanism can be mounted to the stopping element.

The retracting mechanism can comprise a spring wound reel constituting said base portion and a cable wrapped thereon, having said distal end connectable to the holder. The stopping element can further comprise a passage extending between said stopper bottom surface and said stopper top surface, so that when the spring wound reel is disposed at said stopper top surface the cable can pass through said passage.

The holder can have one or more side walls extending from a holder bottom to a perimetric holder rim, and defining together a holder interior space configured for receiving a bottom portion of said container via said holder rim, so as to grip said container at an upside down position of the container. The distal end of the retracting mechanism can be connectable to a center of said holder bottom. The above structure of the holder and, particularly, the fact that the distal end of the retracting mechanism can be connected to the center of the holder bottom allows gripping the container at an upside down position while in the normally retracted position.

The holder can further comprise a gripping mechanism configured for arresting said container to said holder. The clamping can be done by tightening mechanism which, upon activation, tightly grasps the container, for preventing its movement with respect to the holder. One or more side walls have an internal surface which can constitute the gripping mechanism by having shape and size corresponding to a shape and a size of the bottom portion of the container and by having a friction coefficient allowing frictionally introducing and engaging the bottom portion of the container so as to grip the container. The above structure of the gripping mechanism prevents the container from slipping out of the holder while it is held upside down.

The holder interior space can be configured with a first sub-space in proximity to said holder rim having a first diameter D1 and a consecutive second sub-space having a second diameter D2 which is smaller than D1. This structure of two sub-spaces allows using a single holder for holding two containers different in width.

The system can further comprise a mounting arrangement extending from the housing for mounting the housing to an external element.

The system can further comprise a pour spout mountable to an opening of said container in order to control the flow of the liquid in the container in case it is upside down.

BRIEF DESCRIPTION OF THE DRAWINGS

In order to better understand the subject matter that is disclosed herein and to exemplify how it may be carried out in practice, embodiments will now be described, by way of non-limiting examples only, with reference to the accompanying drawings, in which.

DETAILED DESCRIPTION OF EMBODIMENTS

Figure 1:
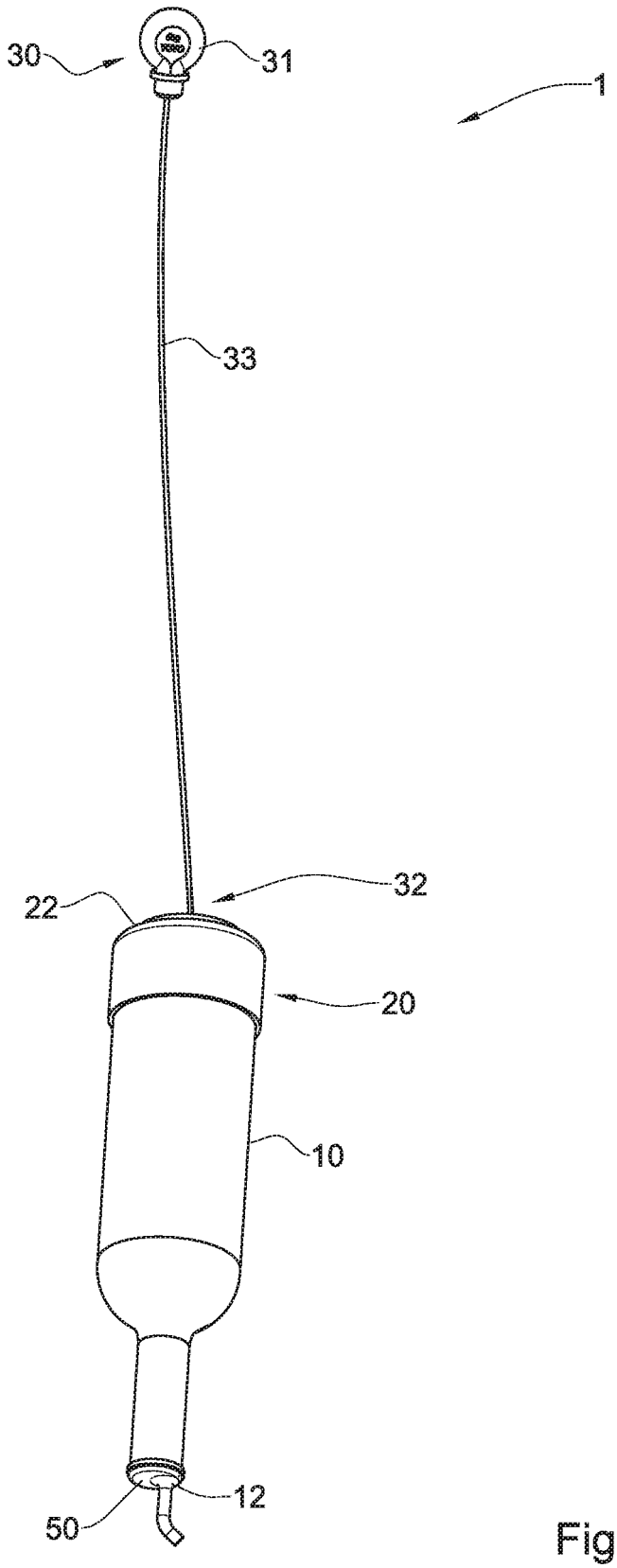
FIG. 1 is an isometric view of a system for holding a container according to one example of the presently disclosed subject matter.
Figure 2:
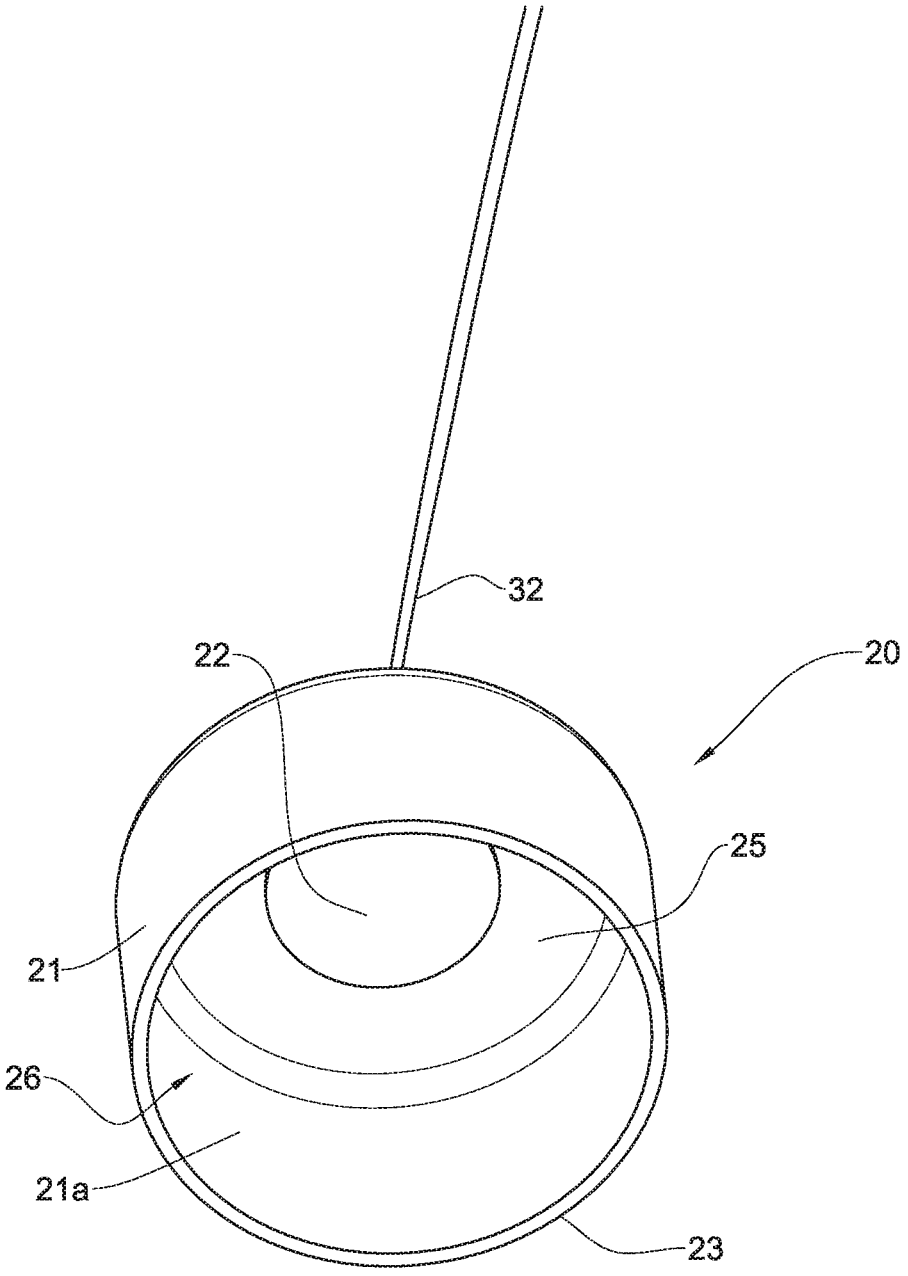
FIG. 2 is an enlarged isometric view of a holder of the system of FIG. 1, without a container received therein.
Figure 3A:
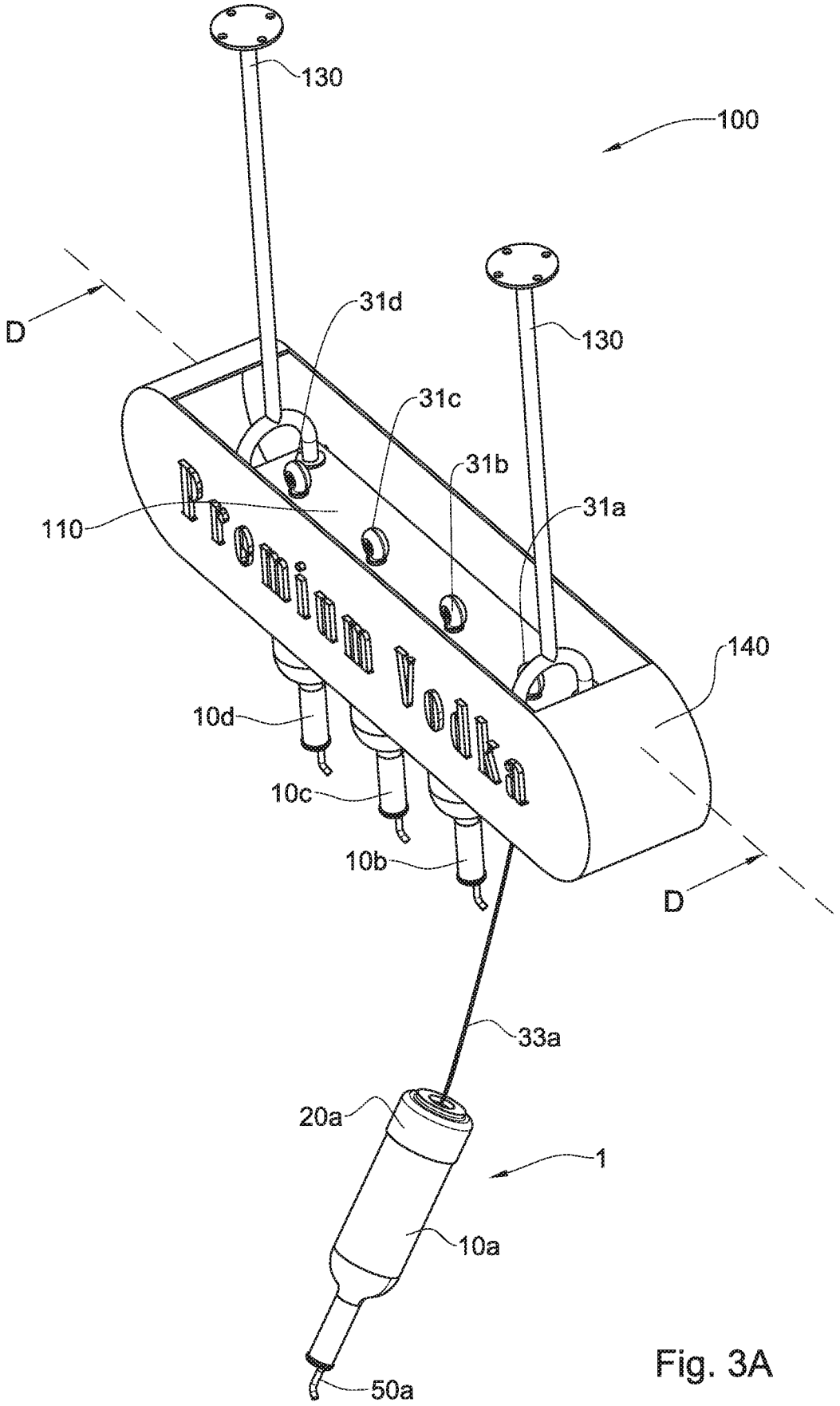
FIG. 3A is an upper isometric view of a system according to another example of the presently disclosed subject matter.
Figure 3B:
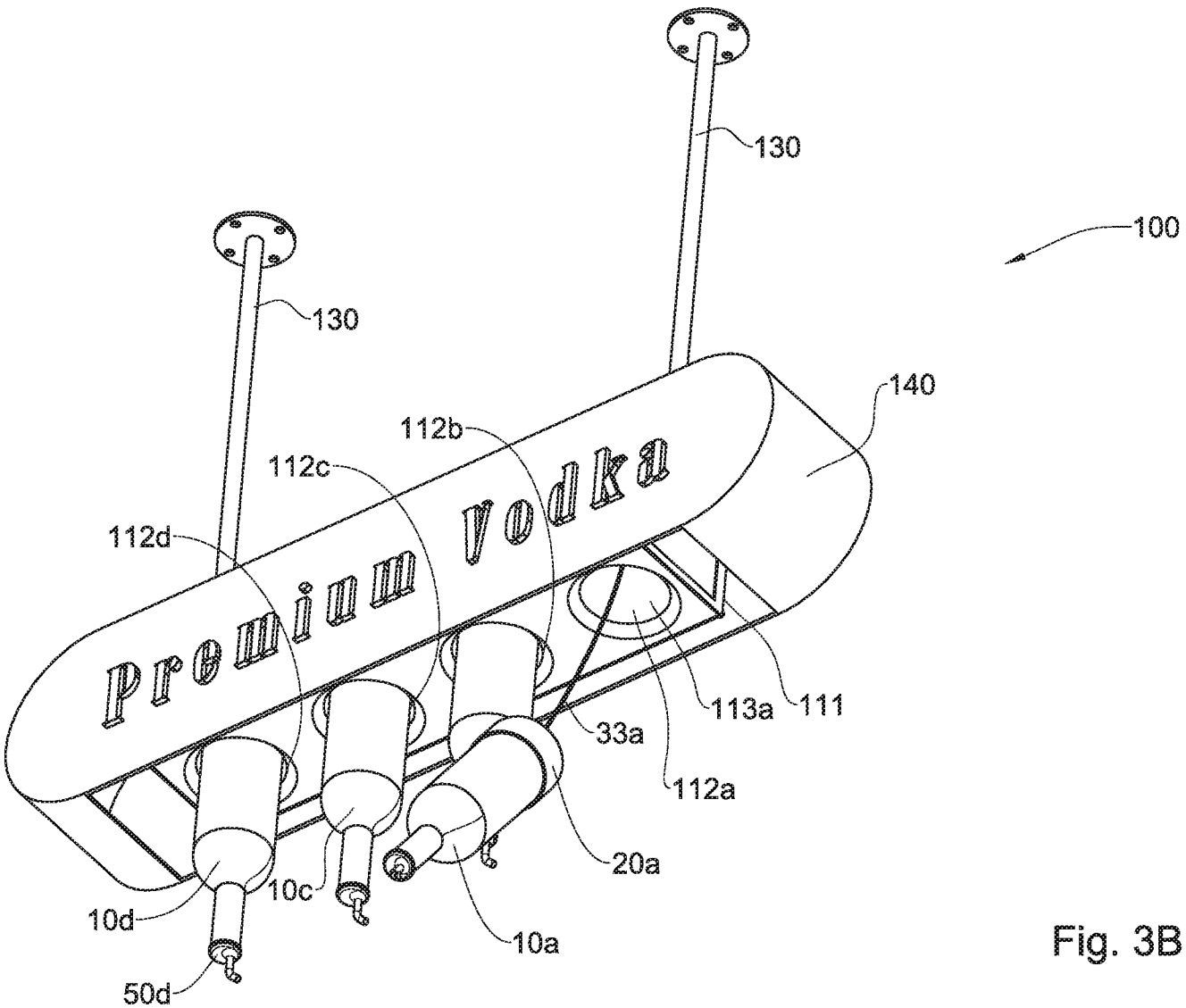
FIG. 3B is a bottom isometric view of the system shown in FIG. 3A.
Figure 3C:
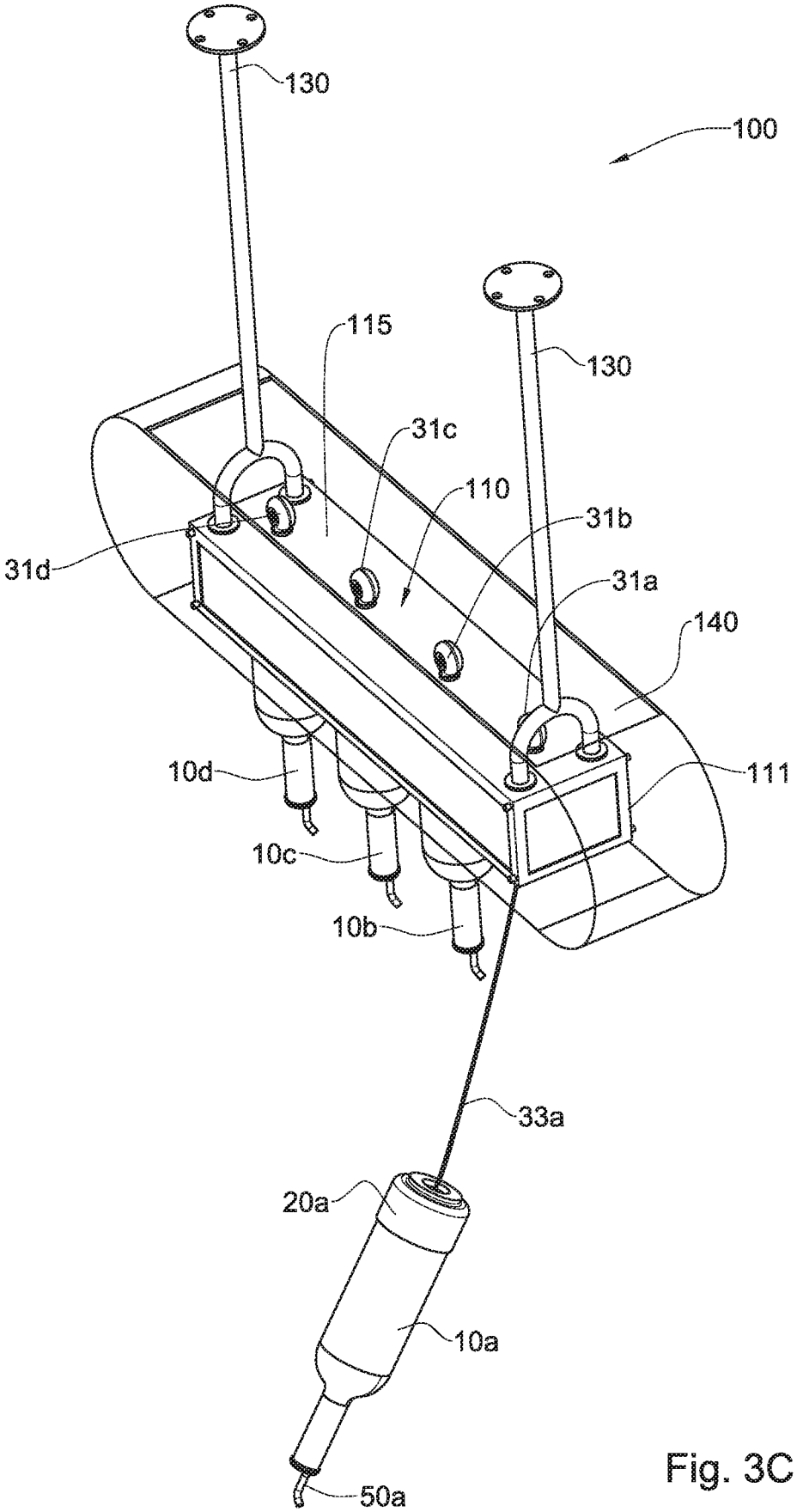
FIG. 3C is an upper isometric view of the system shown in FIG. 3A, with its housing cover being transparent.
Figure 3D:
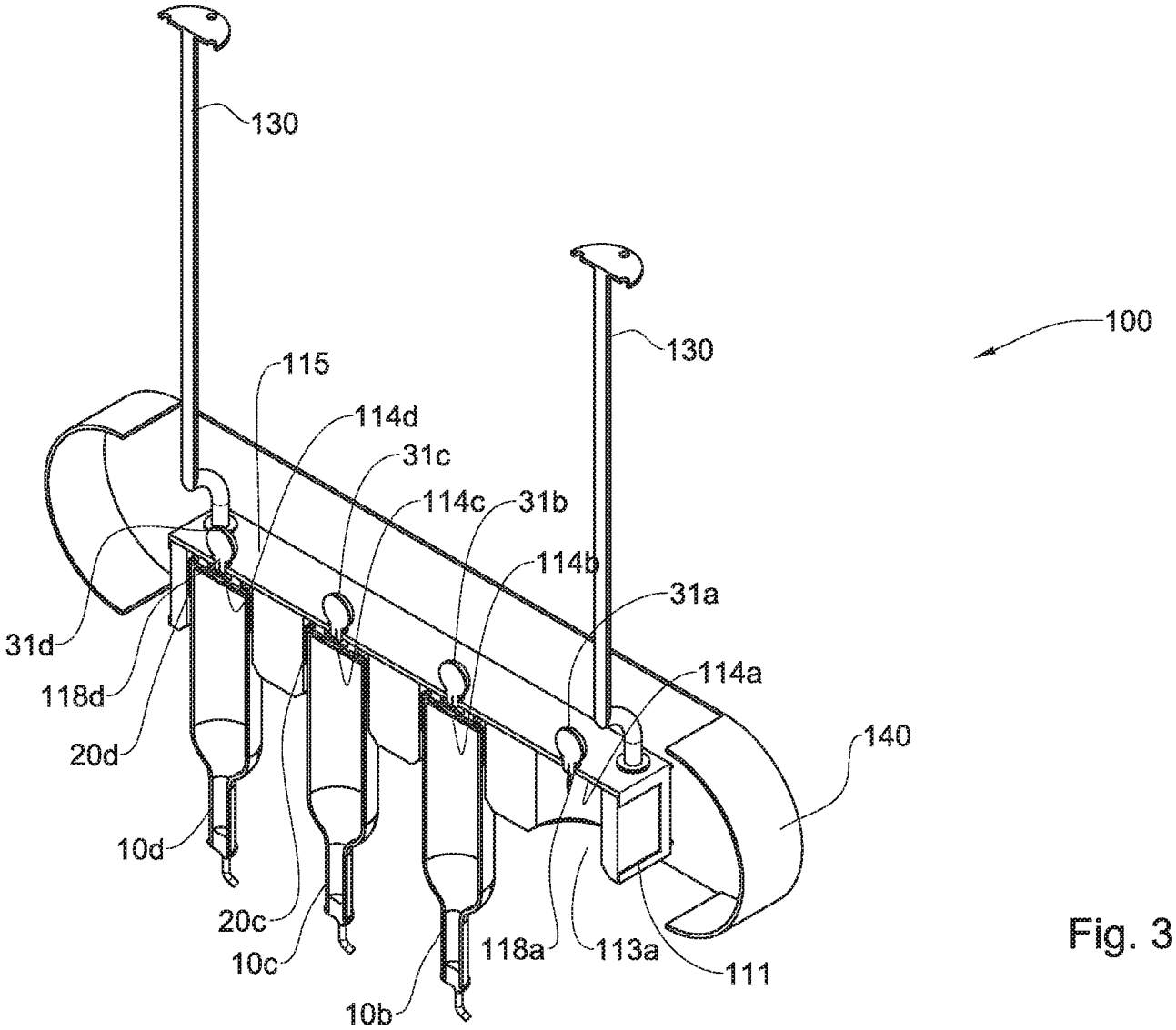
FIG. 3D is a cross-sectional view of the system shown in FIG. 3A taken along a plane D-D.

Reference is now made to FIGS. 1 and 2 in which a system 1 for holding a container in the form of a bottle 10 is shown, in accordance with one example of the presently disclosed subject matter.

The system 1 comprises a holder 20 configured to grip the bottle 10 at an upside down position, and a retracting mechanism 30 connected to the holder 20. The bottle 10 contains an alcoholic beverage, and the system 1 can be used by a bartender in a bar above a workspace (not shown) and the sightline of the bartender. When the bartender is willing to use the bottle 10 in order to serve its liquid, he can pull the bottle 10 together with its holder 20 by his hand towards the workspace, and then to use the bottle. The bottle 10 is configured with a pour spout 50 mounted to an opening 12 thereof in order to control the flow of the liquid from the bottle 10 when being used by the bartender. Once accomplishing serving the liquid, the bartender can lift and release the bottle 10, which in turn will automatically revert to its normally retracted position by the operation of the retracting mechanism 30, as explained below.

The holder 20 is a structure of a peripheral round side wall 21 extending from a holder bottom 22 to a perimetric holder rim 23, and defining together a holder interior space 25. The interior space 25 is configured for receiving a bottom portion (not shown) of the bottle 10 via the holder rim 23, so as to grip the bottle 10 at its upside down position by a gripping mechanism 26.

The gripping mechanism 26 is a friction based mechanism consisting of an internal surface 21*a* of the side wall 21, characterized by a high friction coefficient and is shaped and sized corresponding to the shape and the size of the bottom portion of the bottle 10. This structure of the gripping mechanism 26 prevents the bottle 10 from slipping out of the holder 20 while gripping the bottle 10. For example, the gripping mechanism 26 can be made of a rubber material.

The retracting mechanism 30, shown in FIG. 1, has a base portion in the form of an enclosure 31 mountable to a fixed location (not shown), and a cable 33 extending from the housing and having a distal end 32 connected to the holder 20. In particular, the distal end 32 is connected to a center of the holder bottom 22. The enclosure 31 has a spring wound reel (not shown) enclosure 31 on which the cable 33 is wrapped.

The holder 20 is displaceable by the cable 33 and the spring wound reel of the retracting mechanism 30 between a normally retracted position (shown in FIGS. 3A-3D with respect to three of four containers) and an extended position (shown in FIG. 1). As is clearly understood from the drawings, the length of the retracting mechanism 30 is increased at the extended position more than the length at the retracted position. In particular, at the extended position, the holder 20 is spaced from the enclosure 31 to an extent greater than at the retracted position.

In accordance with another example of the presently disclosed subject matter shown in FIGS. 3A to 3D, there is provided a system 100 which includes a plurality of systems 1. Instead of holding only one bottle by a single holder as suggested by the system 1, the system 100 is provided with a plurality of holders 20*a-d* for holding a plurality of bottles 10*a-d*, respectively, while each of the holders 20*a-d* is displaceable between a retracted position and an extended position.

The system 100 has a housing 110 (best seen in FIG. 3C), constituting a fixed location to which a plurality of enclosures 31*a-d* are mounted.

The housing 110 comprises a rigid cage 111 (shown in FIGS. 3C and 3D) and a stopping element 114 received therein and supported by the rigid cage 111. The rigid case 111 is structured of rigid frame members and a top member 115.

The stopping element 114 has a plurality of openings 112*a-d* with interior spaces 113*a-d* defined by the openings 112*a-d*, for accommodating the holders 20*a-d* together with the bottles 10*a-d*, at their retracted position. The interior spaces 113*a-d* have respective stopper bottom surfaces 114*a-d* configured for delimiting movement of the holders 20*a-d* when being displaced from their extended position to their retracted position. The stopping elements 114*a-d* are made of a soft material, such as soft foam, which functions as a shock absorber for the holders 20*a-d*, when they come in contact with the stopping element 114 and enter into their corresponding interior spaces 113*a-d*. #

The top member 115 has a plurality of passages 118*a-d* extending between an exterior of the top member 115 and the stopper bottom surfaces 114*a-d*, so that enclosures 31*a-d* are disposed above the top member 115 and the cables 33*a-d* pass through the passages 118*a-d*.

The system 100 further comprises a mounting arrangement 130 extending from the top member 115 of the housing 110 for mounting the system 100 to an external element such as a ceiling (not shown).

The system 100 further comprises a housing cover 140 that surrounds the housing 110. The housing cover 140 constitutes a decorative element, the exterior surface of which can be used for advertising or any other informing purposes.

Figure 4A:
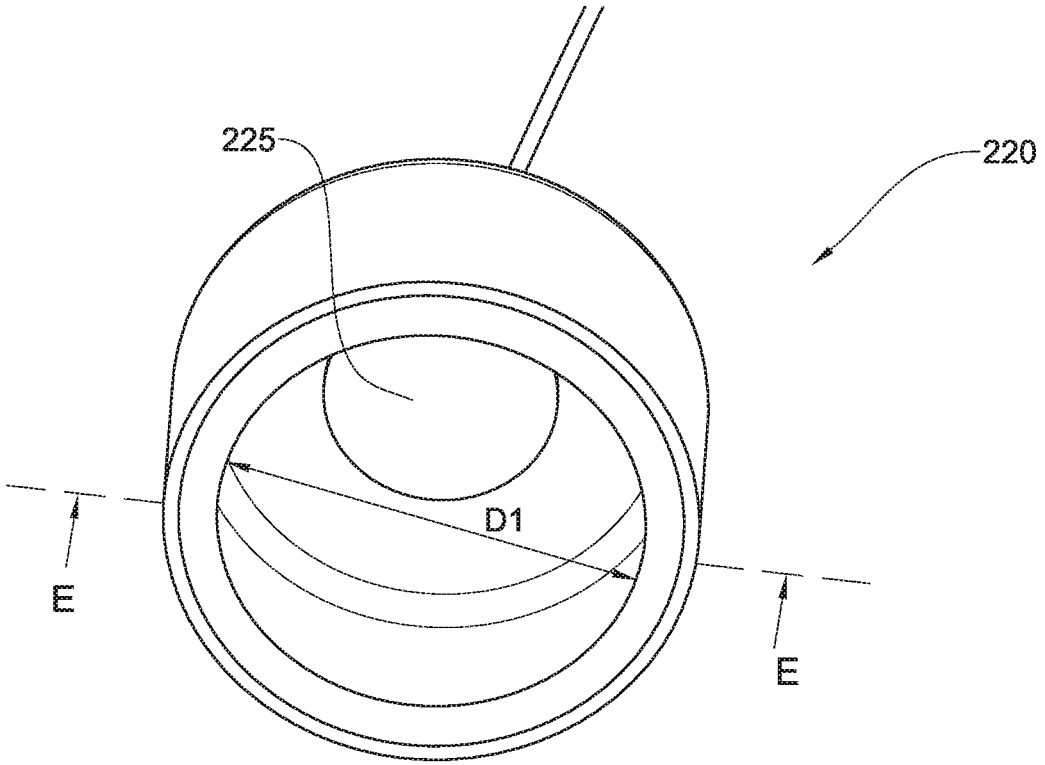
FIG. 4A is another example of a holder, in accordance with another example of the presently disclosed subject matter.
Figure 4B:
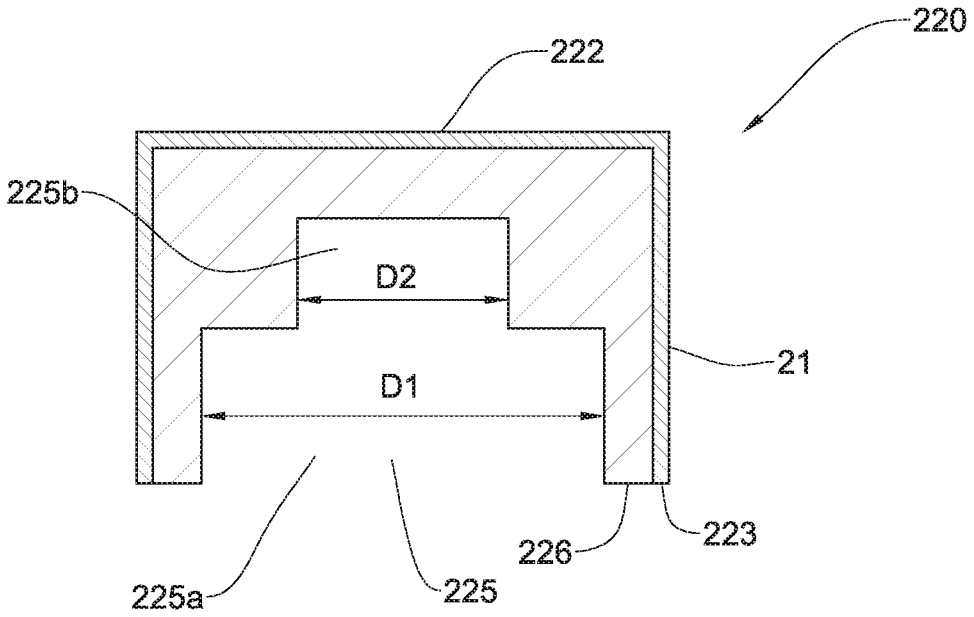
FIG. 4B is a cross-sectional view of the holder of FIG. 4A taken along a plane E-E.

Reference is now made to FIGS. 4A and 4B, showing another example of a holder 220 configured with an interior space 225 having a first sub-space 225*a* in proximity to a holder rim 223 and having a first diameter D1 and a consecutive second sub-space 225*b* having a second diameter D2 which is smaller than D1. This structure of two sub-spaces allows using a single holder 220 for holding two types of bottles having two different diameters, i.e., of a diameter D1, and of a diameter D2.

The invention claimed is:

1. A system for holding a container, comprising:

a housing cover comprising a bottom member, wherein a first opening is formed in the bottom member of the housing cover;

a holder configured to grip and hold said container in an upside down orientation, said holder having a holder bottom and one or more side walls extending from the holder bottom to defining a holder interior space configured for receiving a bottom portion of said container so as to grip said container in the upside down orientation;

a pour spout mountable to an opening of said container, and configured to control flow of content stored in said container at least when said container is in said upside down orientation;

a retracting mechanism comprising:

a spring wound reel enclosure constituting a base portion and at least partially located within the housing cover, the spring wound reel enclosure having a spring wound reel therewithin;

a cable wrapped on said spring wound reel, a distal end of the cable configured to extend through said first opening and being attached to said holder; wherein said holder is displaceable by the cable of said retracting mechanism between a retracted position and an extended position, so that a length of the cable of said retracting mechanism is increased more at said extended position than the length at said retracted position; and wherein the holder bottom is located within the first opening in the retracted position.

2. A system according to claim 1, wherein at the extended position said holder is spaced from the base portion to an extent greater than at said retracted position.

3. A system according to claim 1, wherein the housing cover constitutes a fixed location.

4. A system according to claim 1, wherein said stopping elements is configured for delimiting movement of the holder with respect to the housing cover when being displaced from the extended position to the retracted position.

5. A system according to claim 1, wherein said stopper horizontal bottom surface is planar.

6. A system according to claim 1, wherein said distal end is attached to a center of said holder bottom.

7. A system according to claim 1, wherein said holder comprises a gripping mechanism for securing said container to said holder.

8. A system according to claim 7, wherein each of said one or more side walls has an internal surface constituting said gripping mechanism by having a shape and size configured to correspond to a shape and a size of the bottom portion of the container and by having a friction coefficient configured to grip the container in the upside down orientation.

9. A system according to claim 1, wherein said holder interior space has a first sub-space in proximity to said holder rim and having a first diameter D1 and a consecutive second sub-space having a second diameter D2 which is smaller than the first diameter D1.

10. A system according to claim 1, further comprising a mounting arrangement extending from the housing cover for mounting the housing cover to an external element.

* * * * *